United States Patent [19]

Tsuzuki

[11] Patent Number: 4,558,970

[45] Date of Patent: Dec. 17, 1985

[54] TUNNEL SHIELD STRUCTURE

[76] Inventor: Junichi Tsuzuki, 6-30-8, Seijo, Setagaya-ku, Tokyo 157, Japan

[21] Appl. No.: 520,329

[22] Filed: Aug. 4, 1983

[30] Foreign Application Priority Data

Aug. 6, 1982 [JP] Japan ..... 57-136889

[51] Int. Cl.[4] ..... E21D 11/00; E04C 1/10; F16B 7/00

[52] U.S. Cl. ..... 405/153; 52/583; 403/13; 403/293

[58] Field of Search ..... 405/135, 146, 150–153; 403/305, 13, 14, 286, 287, 293, 296; 404/6; 52/227, 583

[56] References Cited

U.S. PATENT DOCUMENTS

| | | | |
|---|---|---|---|
| 2,239,026 | 4/1941 | Wagner | 403/286 X |
| 2,699,182 | 1/1955 | Baldridge | 403/296 X |
| 3,729,219 | 4/1973 | Crane | 403/296 X |
| 3,969,906 | 7/1976 | McBean | 405/146 |
| 4,047,388 | 9/1977 | Howlett | 405/135 |
| 4,068,957 | 1/1978 | Brems et al. | 403/296 X |
| 4,235,573 | 11/1980 | Peter et al. | 403/13 |

FOREIGN PATENT DOCUMENTS

| | | | |
|---|---|---|---|
| 2375438 | 8/1978 | France | 405/150 |
| 1185061 | 3/1970 | United Kingdom . | |
| 1502207 | 2/1978 | United Kingdom . | |
| 1508040 | 4/1978 | United Kingdom . | |
| 2026064 | 1/1980 | United Kingdom | 405/153 |
| 1585770 | 3/1981 | United Kingdom . | |
| 2055413 | 3/1981 | United Kingdom . | |

*Primary Examiner*—Cornelius J. Husar
*Assistant Examiner*—Nancy J. Stodola
*Attorney, Agent, or Firm*—Body, Vickers & Daniels

[57] ABSTRACT

Arcuate concrete segments of a tunnel wall are joined together in the circumferential direction by an internally threaded fitting embedded in the end of one segment and a bolt extending through an opening in the end of a peripherally adjacent segment and interengaged with the fitting. Longitudinally adjacent segments are interconnected by bolt openings extending longitudinally through the segments and opening into corresponding enlarged conical recesses at the interface between the segments, a conically tapered positioning ring engaging the recesses, and threaded bolts extending through the longitudinally extending openings through the segments and having threaded ends interengaged with a common coupler member located in the corresponding recesses.

3 Claims, 15 Drawing Figures

TUNNEL SHIELD STRUCTURE

BACKGROUND OF THE INVENTION

This invention relates to a tunnel shield structure used in the shield method.

In the shield method is used an erector to sequentially assemble segments such as those of reinforced concrete as a shielding machine is propelled. For interconnecting and assembling the respective segments have been developed and proposed various methods and structures while structures generally put to practical use have embedded fittings interconnected through bolts.

Now, when the segments are assembled annularly, they are required to have united yield strength to resist earth pressure while being interconnected integrally in the direction of a tunnel when uneven subsidence may occur in soft ground. Further they may be required to introduce compressive force in the direction of the tunnel to deflect in the longitudinal direction of the tunnel for preventing the subsidence.

SUMMARY OF THE INVENTION

The present invention has been developed to meet said requirements and improve operability of assemblage and easiness of manufacture. Hereinafter will be detailed the present invention with reference to an embodiment thereof.

DESCRIPTION OF PREFERRED EMBODIMENTS

Figure 2:
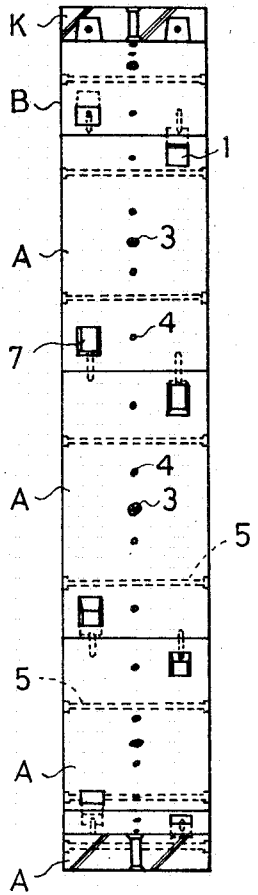
FIG. 2 is a side elevation view, in section, of the shield structure shown in FIG. 1.
Figure 1:
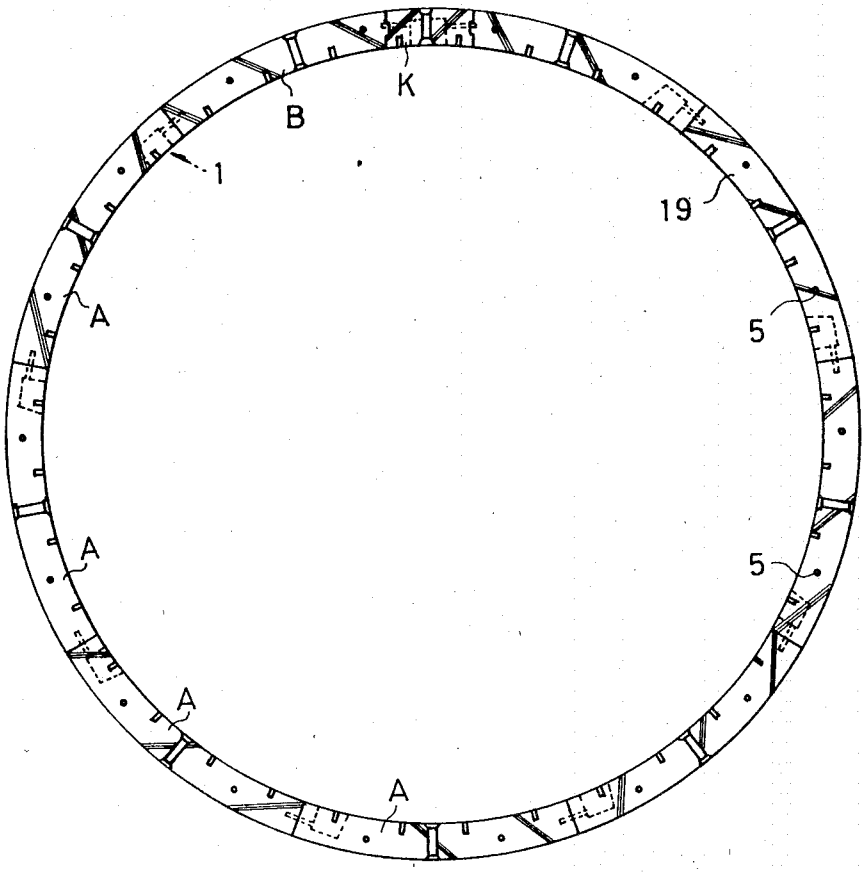
FIG. 1 is an end elevation view, in section, of the shield structure taken in the direction orthogonal to that of a tunnel.
Figure 3:
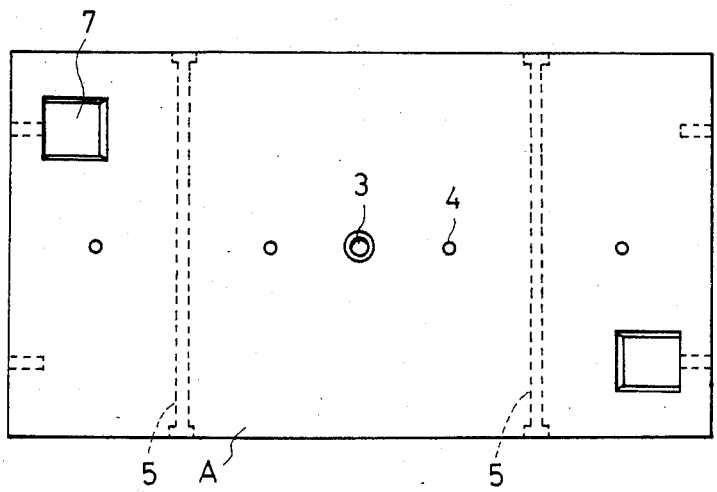
FIG. 3 is a plan view of the radially inner side of a segment A of the shield structure.
Figure 4:
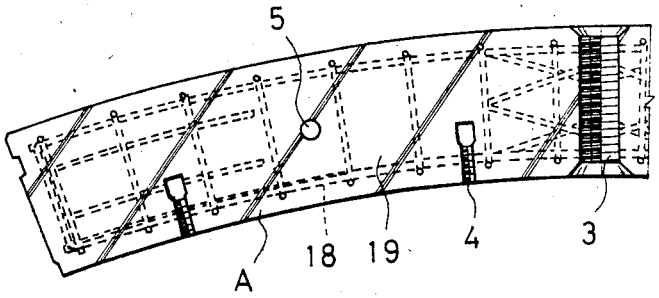
FIG. 4 is a central sectional elevation view of a portion of a segment A as seen in the direction from right to left in FIG. 2.
Figure 5:
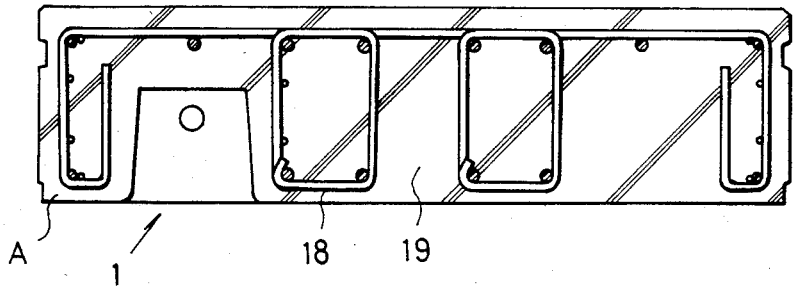
FIG. 5 is a longitudinal sectional elevation view through an end portion of a segment A.
Figure 6:
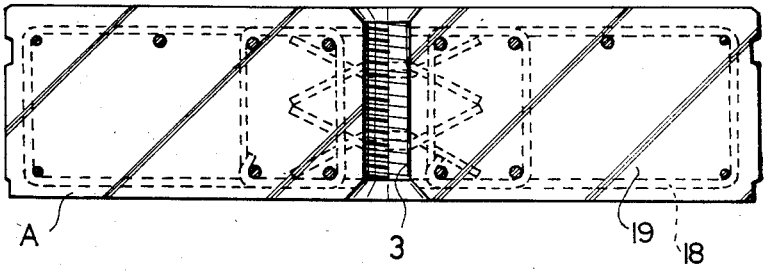
FIG. 6 is a longitudinal sectional elevation view through the central portion of a segment A.
Figure 7:
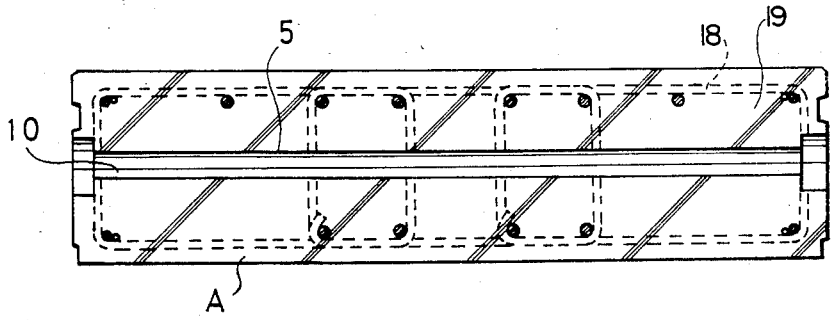
FIG. 7 is a longitudinal sectional elevation view through a segment A intermediate an end and central portion thereof.
Figure 8:
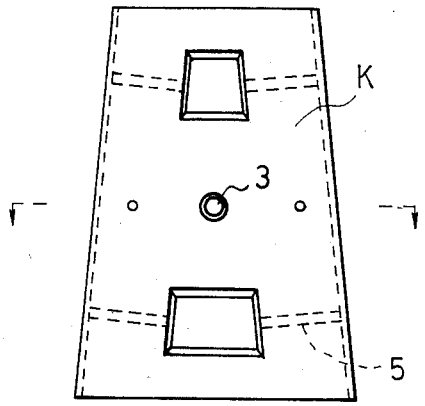
FIG. 8 is a plan view of the interior side of a key segment of the shield structure.
Figure 9:
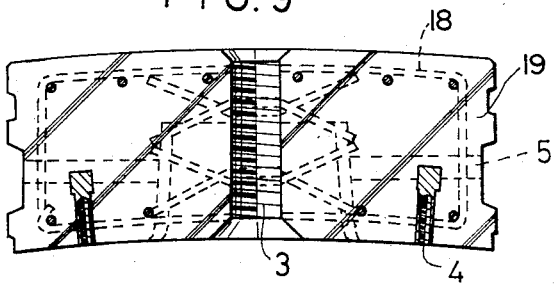
FIG. 9 is a central sectional elevation view of the key segment looking in the direction from right to left in FIG. 2.
Figure 10:
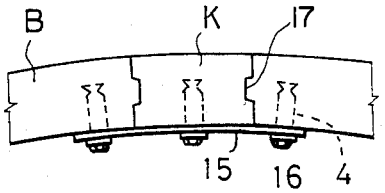
FIG. 10 is an end elevation view showing the key segment in assembled relationship with adjacent segments of the shield structure.
Figure 11:
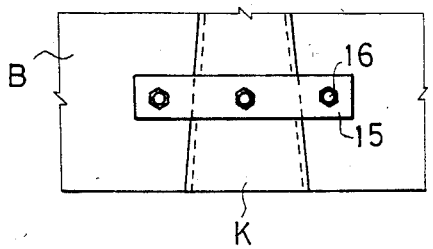
FIG. 11 is a plan view of the assembled key segment looking in the direction from bottom to top in FIG. 10.
Figure 12:
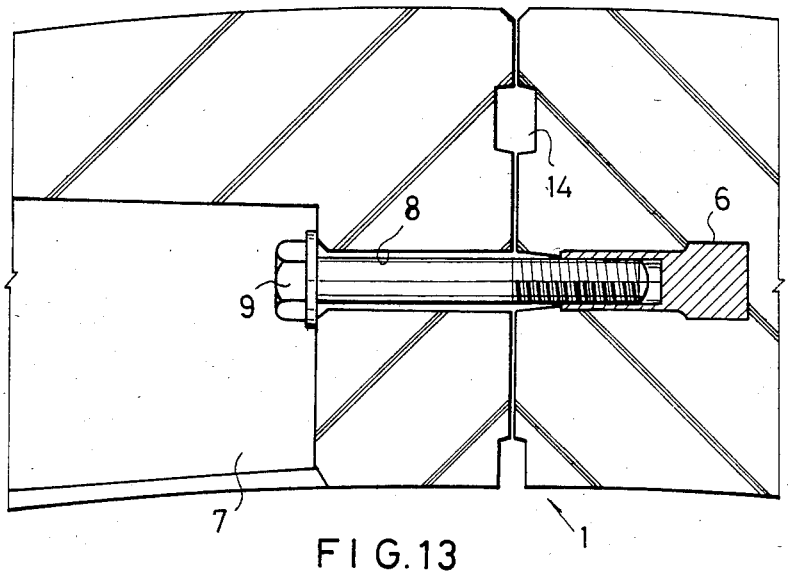
FIG. 12 is a cross-sectional elevation view of a joint structure between circumferentially adjacent ends of segment A.
Figure 13:
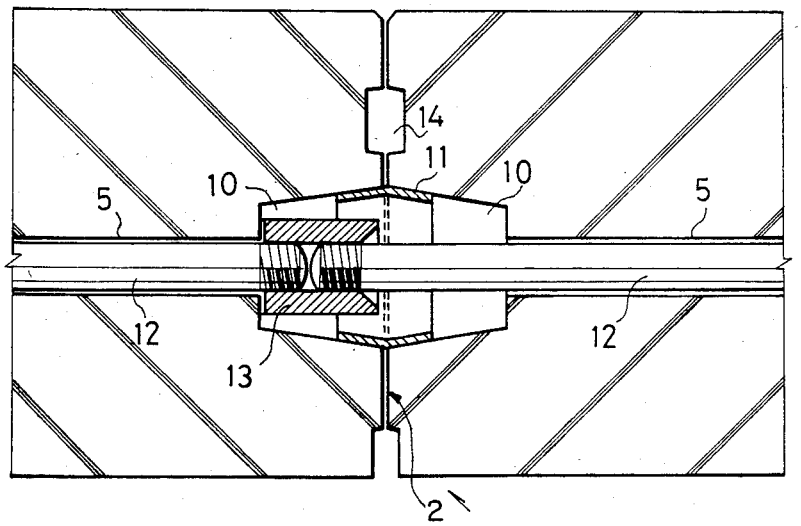
FIG. 13 is a longitudinal sectional elevation view showing a joint connection between longitudinally adjacent segments A.
Figure 14:
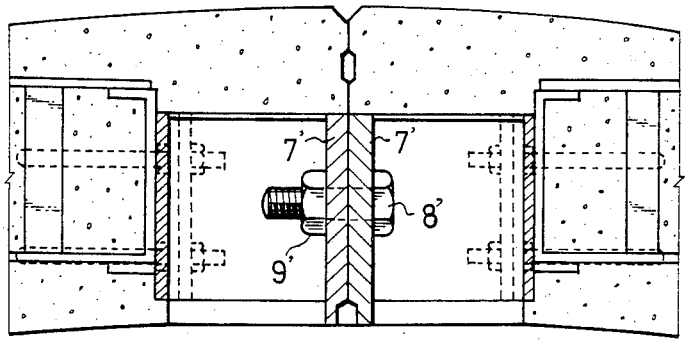
FIG. 14 is a sectional view similar to FIG. 12 and showing a modified joint structure; and, FIG. 15 is a sectional view of another embodiment of the circumferential joint.
Figure 15:
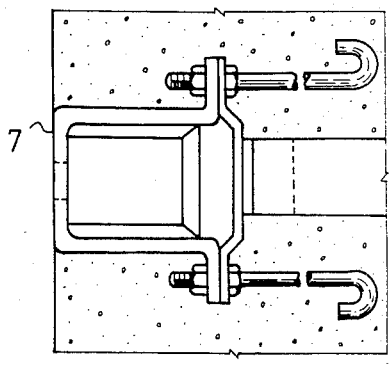

This tunnel shield structure is assembled circumferentially to form an annular body comprising three types of parts, i.e. segments A, segments B and a key segment K, and then constituted from said annular bodies consisting of said respective connectively assembled segments widthwise, i.e. in the direction of a tunnel.

Each segment is provided with a circumferential joint 1 and a widthwise joint 2. Also, in the central portion of each segment is threaded an end of an erector in assembly and embedded an inlet fitting 3 opened to the inner and outer surfaces of the segment and used in back-filling after the assembly. Also, the required number of inserts 4 opened to the inner surface are embedded.

Further, each segment is formed widthwise with a plurality of through holes 5 into which bolts are inserted.

In the circumferential joint 1, an insert fitting 6 opened to a connecting end face of one segment and having an internally threaded hole is embedded in the one segment, and the other segment is formed with a bolt inserting hole 8 opened to the connecting end face following a block-out 7. Segments to be interconnected are abutted to each other and a bolt 9 is inserted into the bolt inserting hole 8 so that the end of the bolt 9 is fixedly threaded into the inserted fitting 6.

In another embodiment, box-shaped connecting fittings 7', 7' having anchors may be embedded in the connecting ends of segments, and the end faces of the connecting fittings 7', 7' are abutted against each other so that a bolt 8' is inserted into the end faces to be fastened by a nut 9'.

The widthwise joint 2 is formed in the connection of end faces of segments with conic recesses 10 communicating to the bolt inserting hole 5, one end of a guide ring 11 tapering toward both ends fitting in one recess 10 and the other end being fitted in the other recess 10 in assembly.

Also, a long bolt 12 is inserted into the bolt inserting hole 5 of each segment and threaded into a coupler 13 at the end. Another bolt 12 inserted into the bolt inserting hole 5 of the next segment is threaded into the coupler 13 so that the long bolts 12 interconnected are fixedly fastened at a required end by a nut.

A gap 14 formed between the connecting end faces of the segments is filled with a sealant.

Further in the embodiment shown, the key segment K is assembled by being pushed in the horizontal direction and fixed by bolts 16 threaded into the insert 4 through a holder plate 15. Also, the key segment K is formed in the widthwise central portion with a recess 17.

Further, symbol 18 designates reinforcing steel bars and symbol 19 concrete.

This invention is thus constituted and the respective segments can be easily circumferentially assembled and connected with large tensile yield strength by the connecting fittings and bolts.

Also, since the respective segments are assembled widthwise or in the direction of a tunnel into the annular body into which the required number of long bolts are inserted to connectively fasten the annular bodies, the segments are united also in the direction of a tunnel, the compressive force can be introduced and uneven subsidence of ground and partially unequal load is to be dealt with and the yield strength of the tunnel shield is to be improved.

What is claimed is:

1. A tunnel shield structure having an axis and comprising a plurality of axially adjacent coaxial rings each comprised of a plurality of arcuate segments of reinforced concrete having circumferentially opposite ends and axially opposite sides, circumferentially adjacent ones of said segments of each ring having circumferentially abutting ends and axially adjacent ones of said segments of said rings having axially abutting sides, first joints between said circumferentially abutting ends each comprising at least one connecting fitting embedded in the segment providing one of said abutting ends and means interengaged with the segments providing the other of said abutting ends and with said connecting fitting to circumferentially hold said circumferentially adjacent segments together, and second joints between said axially abutting sides each comprising axially aligned bolt holes extending through said axially adjacent segments, a conical recess in each of said abutting sides of said segments, said recesses being axially aligned with said bolt holes and diverging in the direction toward the corresponding one of said abutting sides, a guide ring having axially oposite ends each received in and tapered to engage a corresponding one of said conical recesses to hold said axially adjacent rings against relative displacement laterally of said axis, elongated bolts extending through said bolt holes and guide ring and having threaded ends in said conical recesses, and a coupler in said recesses and internally threaded to receive said threaded ends of said bolts to axially hold said axially adjacent rings together.

2. A tunnel shield structure as defined in claim 1, wherein said at least one connecting fitting is an internally threaded member and said means interengaged with the segment providing the other of said abutting ends and said connecting fitting is a threaded bolt extending through an opening in said other end and into threaded engagement with said at least one connecting fitting.

3. A tunnel shield structure as defined in claim 1, wherein said at least one connecting fitting includes first anchor plate means having a first circumferentially extending opening and said means interengaged with said segment providing the other of said abutting ends and said connecting fitting includes second anchor plate means having a second opening aligned with said first opening, and a bolt extending through said openings in said first and second anchor plate means and receiving a nut to hold said circumferentially adjacent segments together, said second anchor plate means being embedded in said segment providing the other of said abutting ends.

* * * * *